US005911181A

United States Patent [19]

Muto

[11] Patent Number: 5,911,181

[45] Date of Patent: Jun. 15, 1999

[54] EMBROIDERY DATA PROCESSING DEVICE

[75] Inventor: Yukiyoshi Muto, Nagoya, Japan

[73] Assignee: Brother Kogyo Kabushiki Kaisha, Aichi-ken, Japan

[21] Appl. No.: 09/021,422

[22] Filed: Feb. 10, 1998

[30] Foreign Application Priority Data

Feb. 12, 1997 [JP] Japan ..... 9-27515

[51] Int. Cl.[6] ..... D05C 5/04; D05B 21/00

[52] U.S. Cl. ..... 112/102.5; 364/470.09

[58] Field of Search ..... 112/102.5, 470.06, 112/475.19, 457, 456, 458, 453; 364/470.09, 470.07

[56] References Cited

U.S. PATENT DOCUMENTS 4,092,938 6/1978 Coughenour et al. ..... 112/457

5,253,599 10/1993 Hashiride ..... 112/102.5

5,357,442 10/1994 Sekine ..... 112/102.5

5,390,126 2/1995 Kongho et al. ..... 112/457 X

*Primary Examiner*—Peter Nerbun

*Attorney, Agent, or Firm*—Kane, Dalsimer, Sullivan, Kurucz, Levy, Eisele and Richard, LLP

[57] ABSTRACT

Disclosed is an embroidery data processing system, which is provided with a system embroidery data storing device, which stores system embroidery data including data of a plurality of embroidery patterns and codes assigned to the data of a plurality of embroidery patterns, respectively. The embroidery data processing system further includes a user embroidery data storing device, which stores user embroidery data including data of embroidery patterns input by a user and codes assigned to the data of embroidery patterns input by the user, respectively. Further, a selecting device is provided for selecting embroidery data corresponding to a code from among the system embroidery data and the user embroidery data.

25 Claims, 9 Drawing Sheets

EMBROIDERY DATA PROCESSING DEVICE

BACKGROUND OF THE INVENTION

The present invention relates to an embroidery data processing device for inputting and editing embroidery data.

Conventionally, embroidery data processing devices for inputting and processing embroidery data have been known. Generally, an embroidery data processing device is constituted such that a hard disk drive, a keyboard, a mouse, a CRT (Cathode Ray Tube) display and the like are connected to a general-use personal computer. In a hard disk, character-shaped embroidery data which is called as an embroidery font is stored in relation to character codes of a character code system (e.g., shifted JIS code, Unicode, ASCII or the like). When a user inputs letters through the keyboard, the embroidery font corresponding to the input letters is read out from the hard disk, and stored in a memory of the personal computer system. By placing thus retrieved plurality of character-shaped embroidery data along a straight or curved line, the embroidery data having the character shape is arranged.

In the conventional system as described above, the character-shaped embroidery data is generally used for embroidering an initial or the like on a jacket, shirt or the like. It takes considerable time to develop the character-shaped embroidery data. Therefore, the character-shaped embroidery data installed in the embroidery data processing system as described above is limited to embroidery data of alphanumerical characters and a limited number of symbols. Thus, it sometimes happens that a character or a symbol which the user intends to embroider may not be included in the character-shaped embroidery data, and in such a case, the user cannot perform embroidering of the character or the symbol. Further, even if the intended character is included in the installed embroidery data, only the predetermined shape of the character is available, and the user has no choice but has to use the installed embroidery font.

SUMMARY OF THE INVENTION

It is therefore an object of the invention to provide an improved embroidery data processing device which can eliminate disadvantages found in the conventional system and to which a user can input character-shaped embroidery data, and use the input character-shaped embroidery data.

For the above object, according to the invention, there is provided an embroidery data processing system, comprising: a system embroidery data storing device, which stores system embroidery data, the system embroidery data including data of a plurality of embroidery patterns and codes assigned to the data of a plurality of embroidery patterns, respectively; a user embroidery data storing device, which stores user embroidery data, the user embroidery data including data of embroidery patterns input by a user and codes assigned to the data of embroidery patterns input by the user, respectively; and a selecting device, which selects embroidery data corresponding to a code from among the system embroidery data and the user embroidery data.

Thus, in the embroidery data processing device according to the present invention, the user can register a desired embroidery data and a code associated therewith and select the registered embroidery data similarly to the system embroidery data.

Optionally, the embroidery data processing system may include an embroidery data editing device for creating new embroidery data; a code assigning device which assigns a code to the new embroidery data created by the embroidery data editing device; and a data registering device which stores the new embroidery data created by the embroidery data editing device and the code assigned to the new embroidery data with the user embroidery data storing device. Accordingly, the user can create new embroidery data and register the same.

When the user creates the new embroidery data, it is possible to modify data of a pattern included in the system embroidery data storing device and/or the user embroidery data storing device.

Optionally or alternatively, when the new embroidery data is created, an embroidery pattern data creating device may be used to create the data from the beginning. Preferably, the newly created data may further be modified.

Further optionally, for a piece of pattern data included in the user embroidery data and corresponding to a piece of pattern data included in the system embroidery data, the user embroidery data storing device may assign the same code as a code assigned to the piece of pattern data included in the system embroidery data. In this case, if both of the system embroidery data and the user embroidery data include data corresponding to a code, it is preferable that the selecting device selects data included in the user embroidery data.

Preferably, the system embroidery data includes at least pattern data of alphanumerical characters, and the code assigned to each pattern data of the system embroidery data may follow a predetermined character code system such as the Unicode system.

Alternatively or optionally, the system embroidery data may include pattern data of symbols, and the code assigned to such pattern data follows a predetermined character code system.

Optionally, the system embroidery data may include pattern data of a string consisting of alphanumerical characters and/or symbols, and the code assigned to each pattern data of the system embroidery data comprises an undefined code of a predetermined character code system.

Further optionally, the user embroidery data may also include pattern data of alphanumerical characters, and the code assigned to each pattern data of the user embroidery data follows the predetermined character code system.

It is preferable that the user embroidery data includes pattern data of symbols. In this case, the code assigned to each pattern data of the user embroidery data may follow the predetermined character code system.

Preferably, the code assigned to each pattern data of the user embroidery data comprises an undefined code of the predetermined character code system.

Optionally, the user embroidery data may include pattern data of a string consisting of alphanumerical characters and/or symbols. In this case, the code assigned to each pattern data of the user embroidery data may preferably comprise an undefined code of the predetermined character code system.

Optionally, the embroidery data processing system may further be provided with a data storing medium which stores embroidery data selected by the selecting device. Preferably, such a data storing medium can be detachablly connected to an embroidery sewing machine, and the embroidery data stored in the data storing medium may be transmitted from the data storing medium to the embroidery sewing machine when the data storing medium is connected to the sewing machine.

According to another aspect of the invention, there is provided a memory medium for storing programs for an embroidery data processing system, the programs comprising: a program for storing system embroidery data which includes data of a plurality of embroidery patterns and codes assigned to the data of a plurality of embroidery patterns, respectively; a program for storing user embroidery data which includes data of embroidery patterns input by a user and codes assigned to the data of embroidery patterns input by the user, respectively; and a program for selecting embroidery data corresponding to a code from among the system embroidery data and the user embroidery data.

According to further aspect of the invention, there is provided an embroidery data processing system, comprising: means for storing system embroidery data, the system embroidery data including data of a plurality of embroidery patterns and codes assigned to the data of a plurality of embroidery patterns, respectively; means for storing user embroidery data, the user embroidery data including data of embroidery patterns input by a user and codes assigned to the data of embroidery patterns input by the user, respectively; and means for selecting embroidery data corresponding to a code from among the system embroidery data and the user embroidery data.

DETAILED DESCRIPTION OF THE PREFERRED EMBODIMENTS

Hereinafter, the invention will be described with reference to the accompanying drawings.

In the following description, an embroidery data processing device is described as an embodiment of the invention. The embroidery data processing device retrieves embroidery data, which is stored in a hard disk drive of a personal computer system, corresponding to characters input through a keyboard, arranges the retrieved embroidery data along straight and/or curved lines, and then stores the data indicative of the arranged embroidery data in a recording medium such as a flash memory card.

Figure 1:
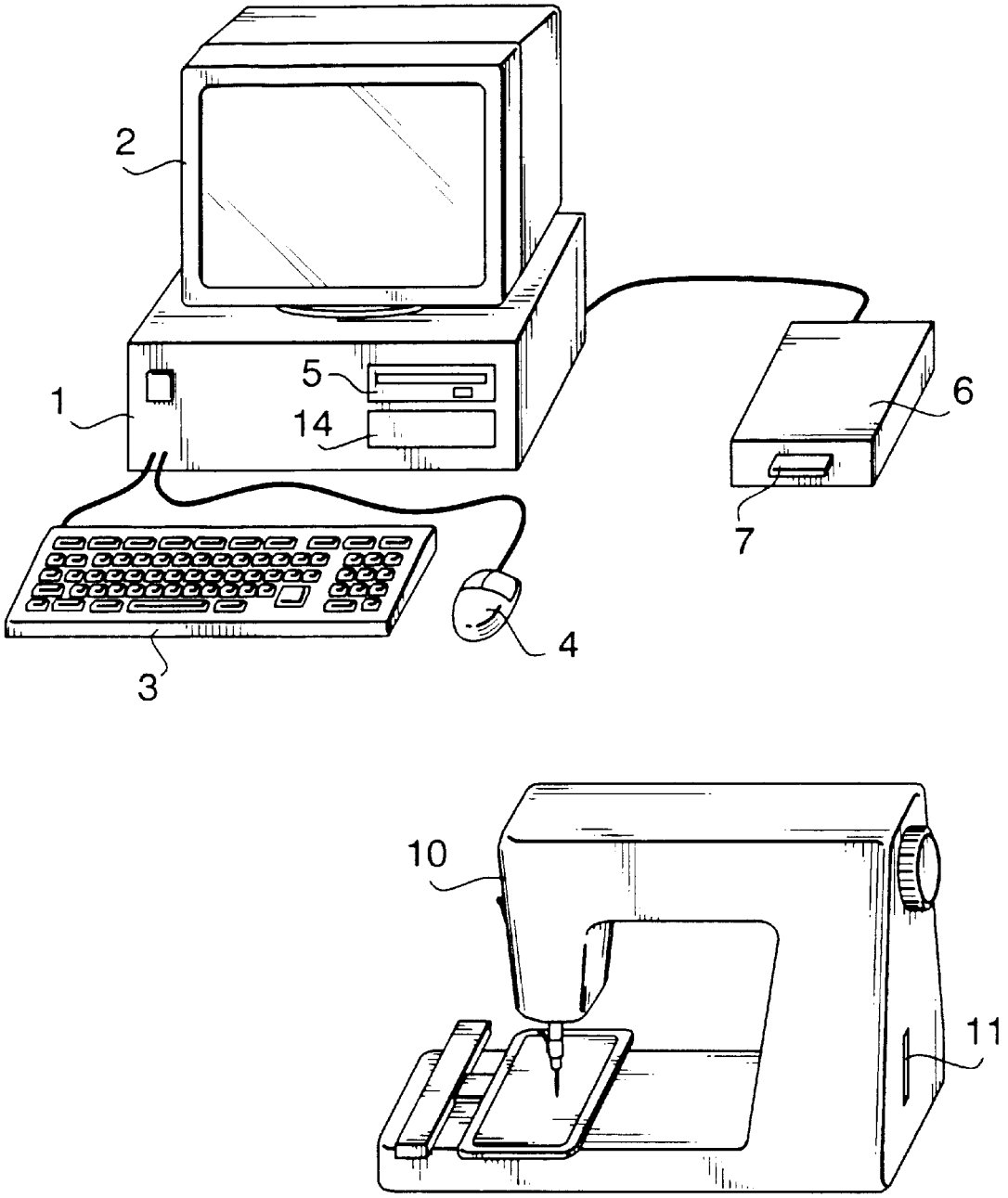
FIG. 1 shows a schematic perspective view of an embroidery system including an embroidery data processing device and an embroidery sewing machine.

FIG. 1 shows an embroidery system including an embroidery data processing device embodying the invention, and an embroidery sewing machine.

Figure 2:
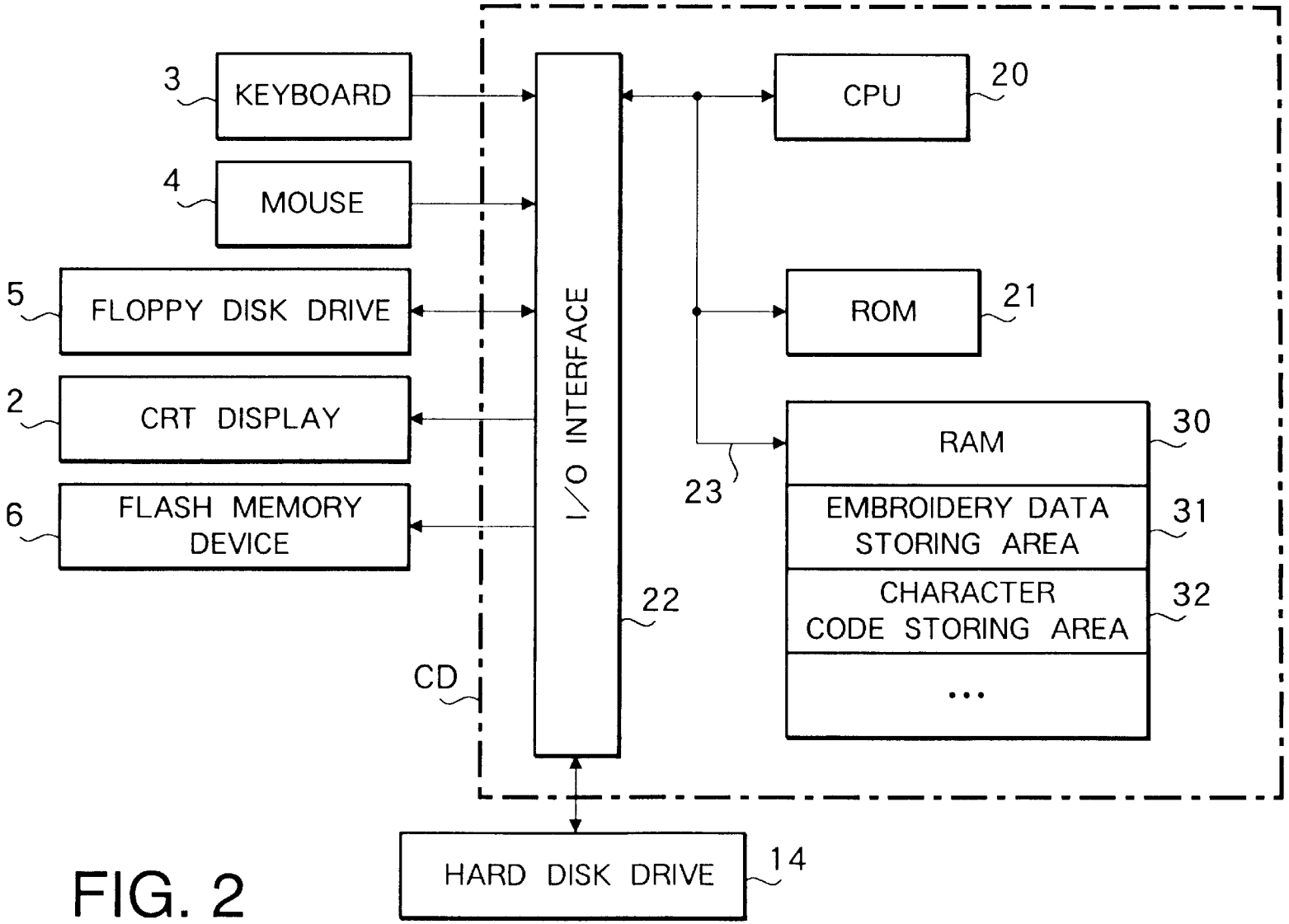
FIG. 2 is a block diagram illustrating a control system of the embroidery data processing device.

As shown in FIG. 1, the embroidery data processing device includes a CRT (Cathode Ray Tube) display 2 for displaying a shape of a character pattern to be embroidered, a keyboard 3 and a mouse 4 for inputting coordinate points defining the shape of the embroidery character patterns and/or selecting menu items, a floppy disk drive 5 and a hard disk drive 14 for storing embroidery data, a flash memory device 6 for writing the embroidery data into a memory card 7 which is removable from the flash memory device 6. The memory card 7 includes a non-volatile flash memory. The floppy disk drive 5 and the hard disk drive 14 are accommodated in a main body 1 of a control device CD (FIG. 2). The CRT display 2, the keyboard 3, the mouse 4, and the flash memory device 6 are connected to the main body 1.

The embroidery sewing machine 10 is provided with a frame on a machine bed for holding work cloth. The frame is moved by a horizontal moving mechanism (not shown) according to data indicative of X-Y coordinates intrinsic to the sewing machine 10. Simultaneously with movement of the frame, a sewing needle and a rotating hook mechanism are driven, and a sewing operation is executed to embroider a certain pattern on the working cloth held by the frame.

In this case, the horizontal moving mechanism and a needle rod are controlled to move by a controller which includes a microcomputer and the like. Therefore, the controller executes an embroidering operation automatically in accordance with the data indicative of moving amount (indicated by X-Y coordinates) of the working cloth at each stitch.

The embroidery sewing machine 10 is further provided with a flash memory device 11 in which the memory card 7 is inserted and the embroidery data can be retrieved therefrom. The embroidery data processing device according to the invention is capable of creating the embroidery data to be used in the embroidery sewing machine as described above.

FIG. 2 shows a control system of the embroidery data processing device. The main body 1 houses the control device CD. To an I/O (input/output) interface 22 of the control device CD, the CRT display 2, the keyboard 3, the mouse 4, the floppy disk drive 5, the flash memory device 6 and the hard disk drive 14 are connected.

The control device CD includes a CPU (Central Processing Unit) 20 which is connected with the I/O interface 22 through a bus 23 such as a data bus. Further, a ROM (Read Only Memory) 21, and a RAM (Random Access Memory) 30 are connected to the bus 23. The ROM 21 stores a control program for executing an embroidery data creating procedure. The RAM 30 includes an embroidery data storing area 31 for storing character embroidery data, a character code storing area 32 for storing character codes, and the like.

Figure 3:
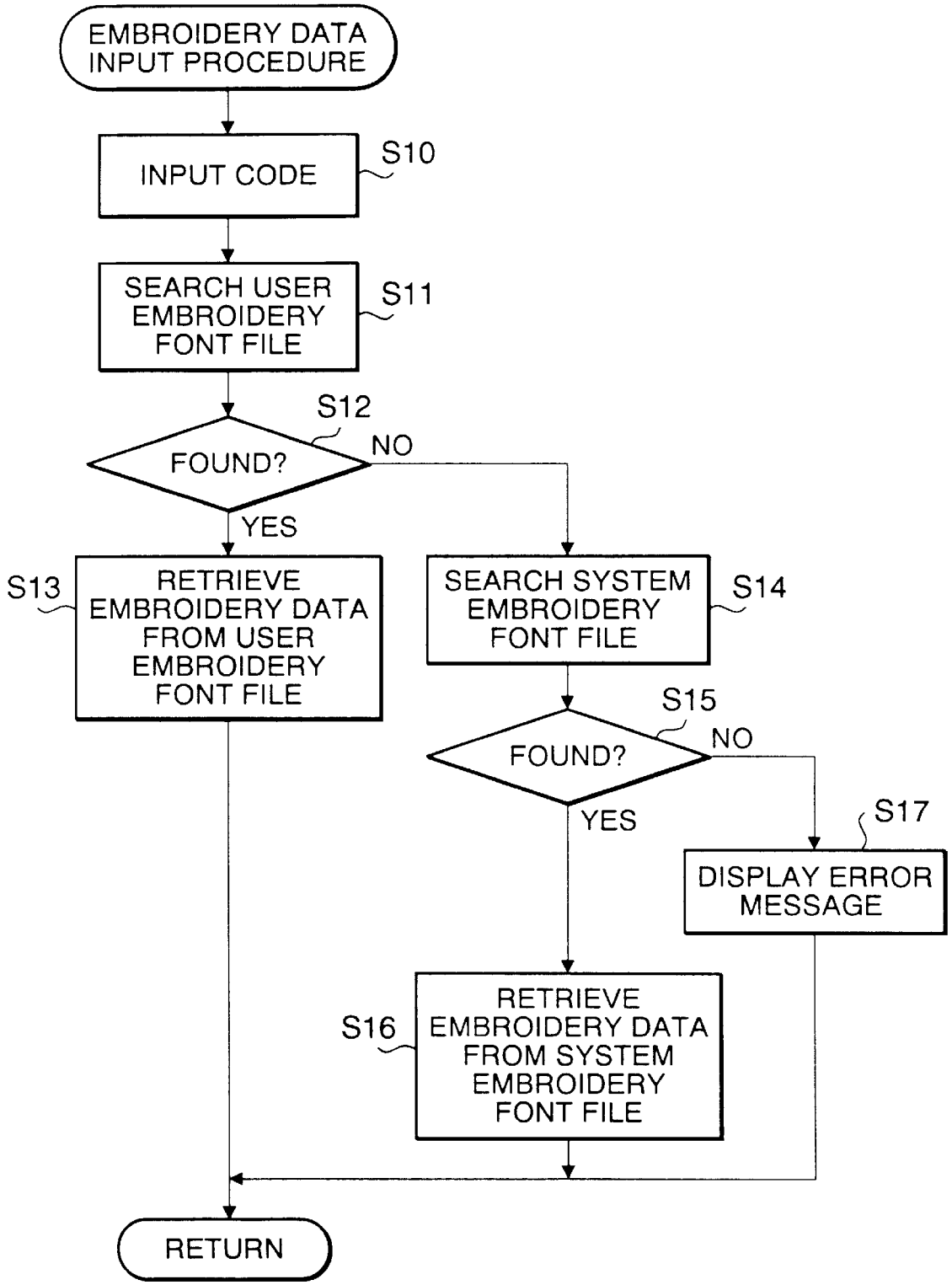
FIG. 3 is a flowchart illustrating an embroidery data input procedure.

FIG. 3 is a flowchart illustrating an embroidery data input procedure executed by the control device CD. It should be noted that in the drawings and the following description, S1, S2, . . . represent steps of flowcharts, and that the Unicode system is used as a character code system.

When a predetermined key of the keyboard 3 is operated, the procedure shown in FIG. 3 is initiated.

A user inputs, through the keyboard 3, a character code whose embroidery data is to be obtained. The input character code is stored in the character code storing area 32 (S10). In S11, it is determined whether character-shaped embroidery data corresponding to the input character code is included in a user embroidery font file (S11).

Figure 7:
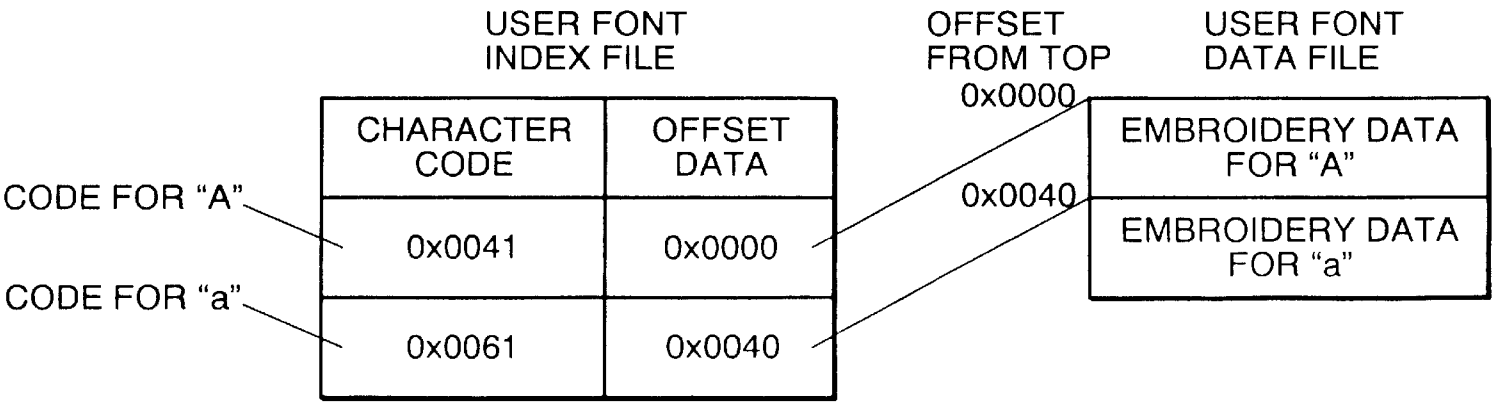
FIG. 7 shows a structure of the user embroidery font file.

An example of the user embroidery font file is shown in FIG. 7. As shown in FIG. 7, the user embroidery font file has a user font index file and a user font data file. The user font index file includes a table indicating combinations of character codes and corresponding offset data indicative of offset values with respect to a top address of the user embroidery font data file.

Then, it is determined whether the input character code is included in the user font index file, from the top of the index file, one by one. If there is the same code as the input code in the user font index file (S12:YES), the user font data corresponding to the input character code is retrieved based on the offset data stored in the user font index file, and stored in the embroidery data storing area 31 (S13).

Figure 5:
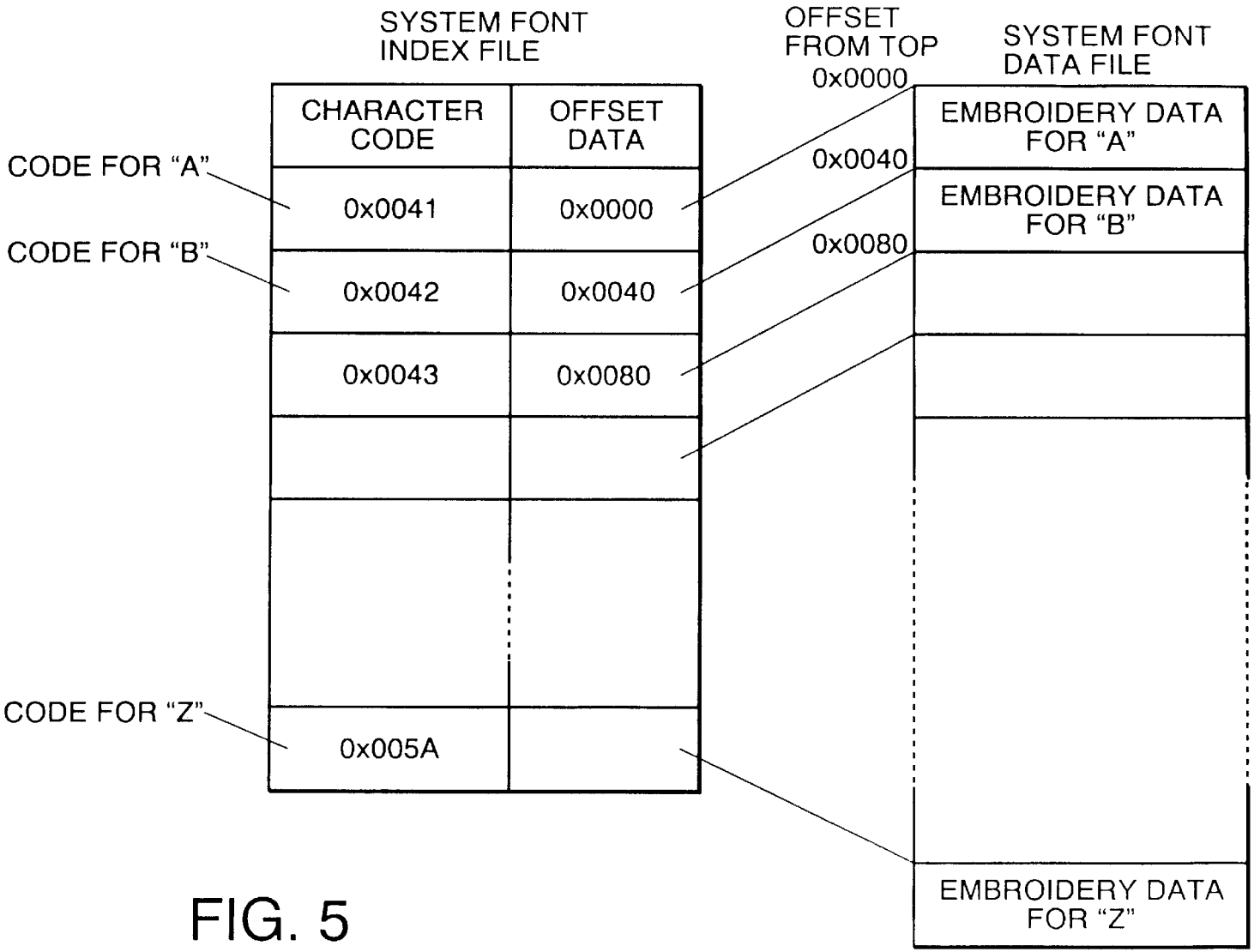
FIG. 5 shows a structure of a system embroidery font file.
Figure 6:
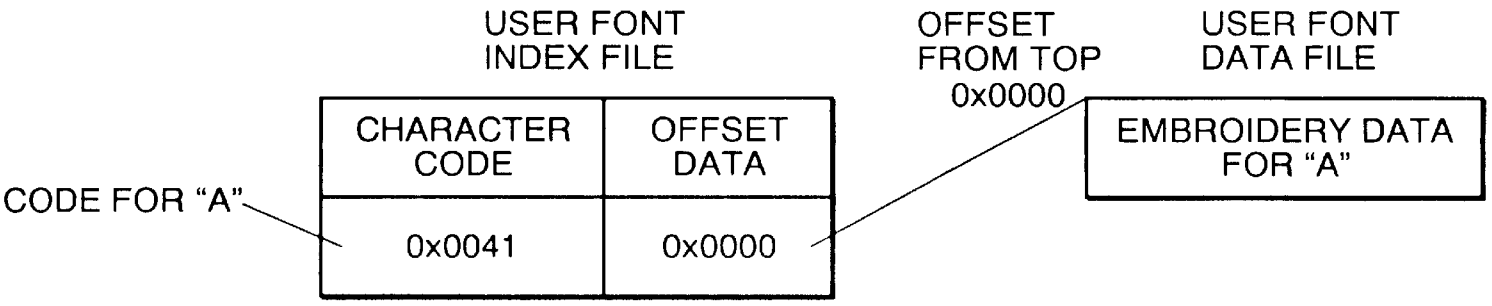
FIG. 6 shows a structure of the user embroidery font file.

If the input character code is not included in the user font index file (S12:NO), it is determined whether a system embroidery font file includes data corresponding to the input character code (S14). As shown in FIG. 5, the system embroidery font file includes a system font index file and a system font data file. If a character code is given, the embroidery data corresponding to the given character code can be retrieved, with reference to the system font index file, from the system font data file.

Specifically, the input character code is compared with character codes stored in the system font index file from the top thereof. If the code same as the input character code is found (S15:YES), the embroidery data corresponding to the input character code is retrieved from the system font data file in accordance with a location of the data indicated by the offset data stored in the index file, and then the retrieved embroidery data is stored in the embroidery data storing area 31 (S16). If the system font index file does not include the input character code, an error message is displayed on the CRT display 2 (S17).

Figure 8:
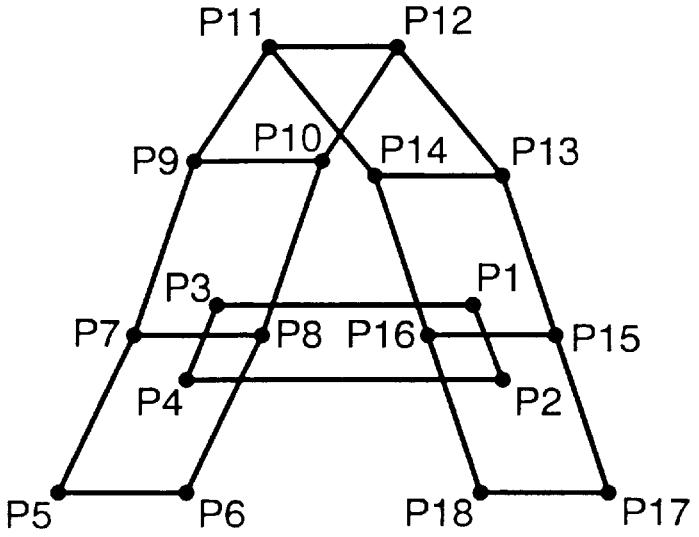
FIG. 8 shows an example of embroidery data for character "A" registered with the system embroidery font file.
Figure 9:
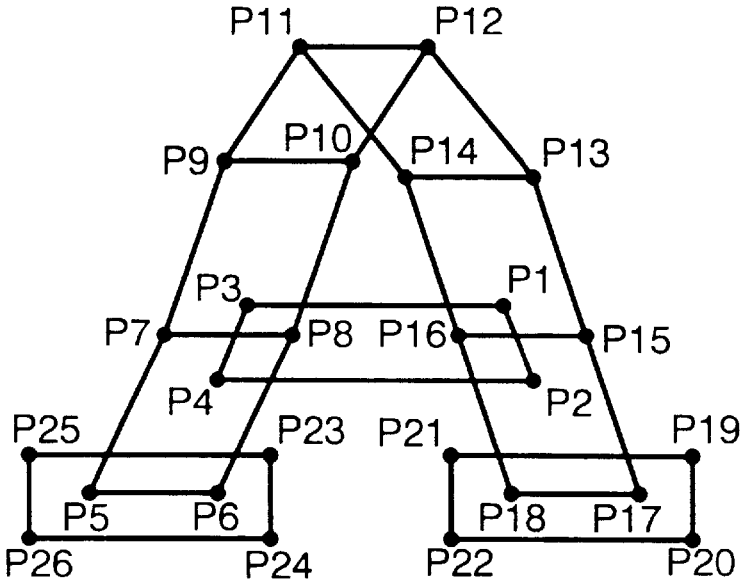
FIG. 9 shows an example of embroidery data for character "A" registered with the user embroidery font file.

In the example shown in FIG. 5, the system font index file includes character codes for letters "A" to "Z" (upper case) and the offset data corresponding to the respective character codes. FIG. 8 shows an example of the embroidery data for the character "A". Further, FIG. 7 shows an example of the user font index file which includes characters "A" and "a". In this example, the embroidery data for character code "A" is as shown in FIG. 9. If the user input a code [0x0041] (Unicode), the CPU 20 determines that the user embroidery font file includes the corresponding embroidery data (S12:YES). Then, in S13, the embroidery data as shown in FIG. 9 is retrieved from the user font data file. It should be noted that, in the expression of the code used in this specification, "0x" means the following digits represent a hexadecimal code.

If the user input a code [0x0042] for character "B" at S10, the CPU 20 determines that the user font data file does not include the embroidery data for the character code (S12:NO). In this case, control proceeds to S14 in which the CPU 20 searches the system embroidery font file for the character code. Then, it is determined that the system embroidery font file includes the embroidery data corresponding to the character "B" (S15:YES), and the embroidery data corresponding to the character code is retrieved in S16.

If the input character code is not included either in the user embroidery font file (S12:NO) or in the system embroidery font file (S15:NO), an error message is displayed on the CRT display 2.

Next, an embroidery data registration procedure for registering character embroidery data with a user embroidery font file executed by the control device CD will be described with reference to FIG. 4.

Figure 4:
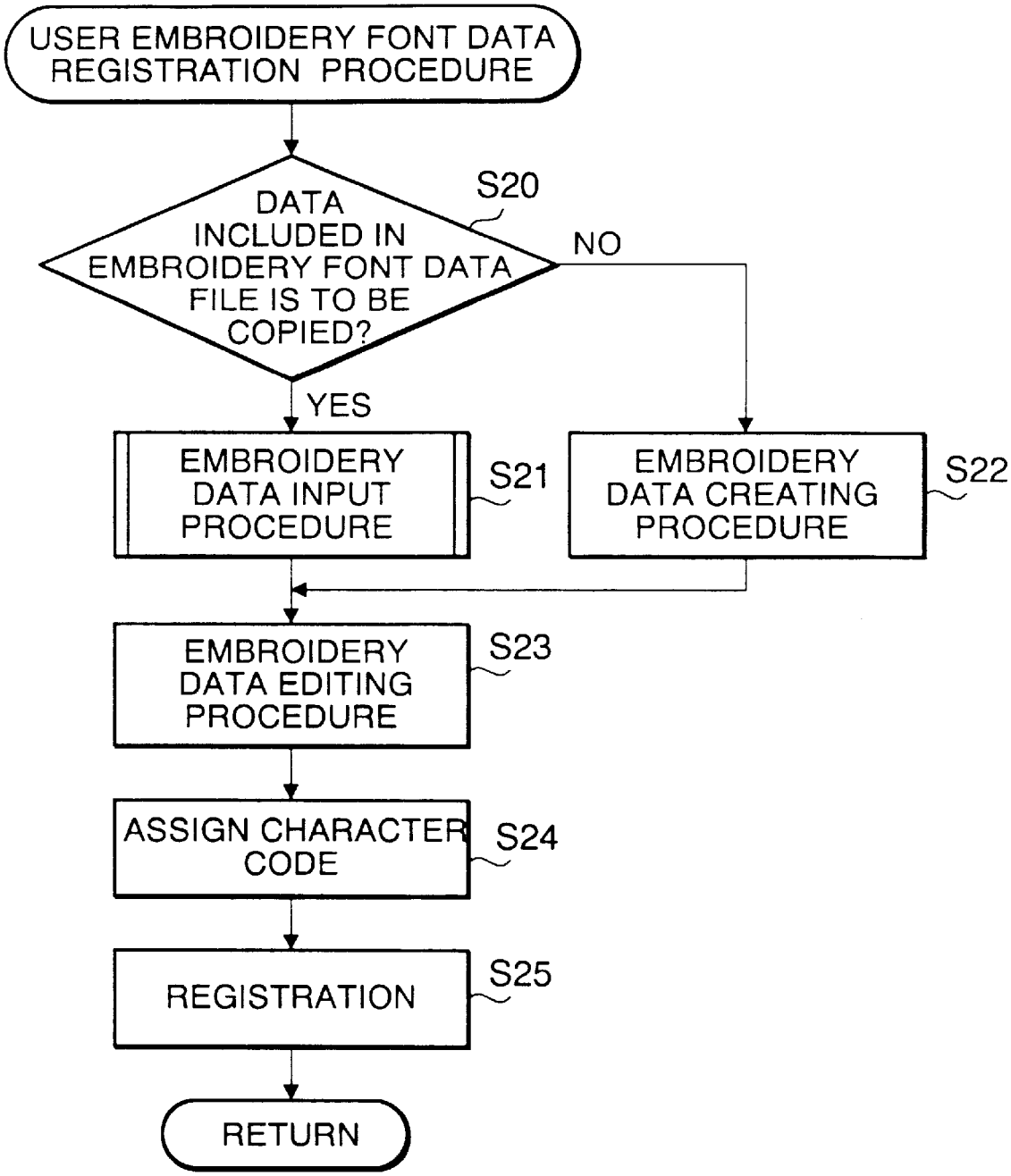
FIG. 4 is a flowchart illustrating a user embroidery font data registration procedure.

FIG. 4 is a flowchart illustrating a user embroidery font data registration procedure. By operating a predetermined key of the keyboard 3, the user embroidery font data registration procedure is initiated. The data which is to be registered may be made newly or made by modifying data included in the embroidery font files.

Firstly, the user is required to select whether character embroidery data included in the embroidery font files is to be copied for modification in S20. If the user intends to modify the character embroidery data already included in the embroidery font files (S20:YES), the CPU 20 executes, in S21, the embroidery data input procedure described above (see FIG. 3), and the character embroidery data to be modified is copied into the embroidery data storing area 31.

If the user does not intend to modify the data included in the embroidery font files (S20:NO), an embroidery data creating procedure is executed (S22). In this step, new embroidery data prepared in advance may be used, or a new data may be created with use of the personal computer system, and the new embroidery data is stored in the embroidery data storing area 31.

When the embroidery data is created, any one of various conventional methods for creating embroidery data may be used. Examples of such methods are: a method for inputting each stitching point configuring a pattern with use of a point inputting device such as a mouse; a method utilizing a combination of quadrilateral patterns known as embroidery blocks; and a method using an outline of image data and dividing the inside areas of the outline into a plurality of embroidery blocks. In the procedure of S22, the embroidery data created with use of such a method is stored in the embroidery data storing area 31.

Then, an embroidery data editing procedure is executed (S23), where the embroidery data stored in the embroidery data storing area 31 may be modified. In this procedure, for example, stitching points may be added or deleted, and/or embroidery blocks may be added or deleted, with use of the mouse 3.

Specifically, in the procedure of S21, the data as shown in FIG. 8 which has been included in the system embroidery font data file is copied into the embroidery data storing area 31. Then, in the procedure of S23, the pattern shown in FIG. 8 is modified to the pattern shown in FIG. 9, in which an embroidery block defined by four points P19, P20, P21 and P22, and another embroidery block defined by four points P23, P24, P25 and P26 have been added.

To this modified embroidery data, a character code is assigned, and then the assigned character code is stored in the character code storing area 32 (S24). The character code may be input through the keyboard 3 by typing a key corresponding to the character code to be assigned or by typing the character code to be assigned directly. Alternatively or optionally, the character code to be assigned may be selected from among character codes displayed on the CRT display 2.

In S25, the embroidery data (the pattern data) which is stored in the embroidery data storing area 31 in step S21 or S22, and modified in step S23, and the character code which is assigned in S24 and stored in the character code storing area 32, are registered with the user embroidery font file. Specifically, the embroidery data stored in the embroidery data storing area 31 is added to the user font data file, and the offset value indicative of the location of the added data with respect to the top of the user font data file and the character code stored in the character code storing area 32 are added to the user font index file.

The invention may be embodied in other specific forms without departing from the spirit of essential characteristics thereof. The present embodiment is therefore to be considered in all respect as illustrative and not restrictive, the scope of the invention being indicated by the appended claims rather than by the foregoing description and all changes which come within the meaning and range of equivalency of the claims are therefore intended to be embraced therein.

Figure 10:
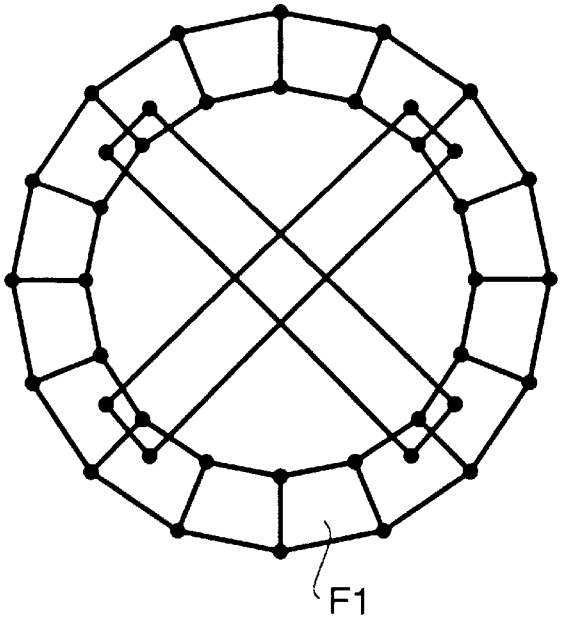
FIG. 10 shows an example of embroidery data for a symbol which can be registered with the user embroidery font file.
Figure 11:
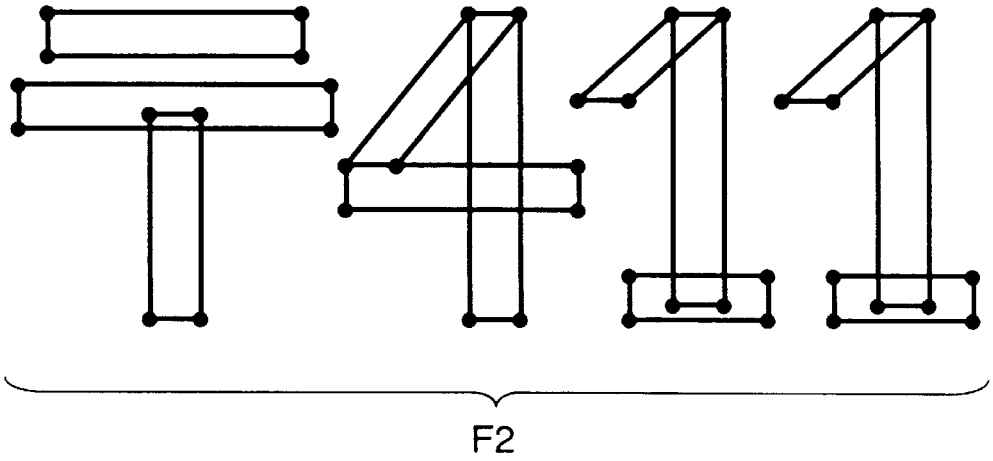
FIG. 11 shows an example of embroidery data for a symbol and alphanumerical characters which can be registered with the user embroidery font file.

For example, the embroidery patterns to be registered can include a pattern of symbols, such as a symbol F1 shown in FIG. 10, or a pattern of a string consisting of symbols, alphanumerical characters, and the like such as a string F2 shown in FIG. 11.

Figure 12:
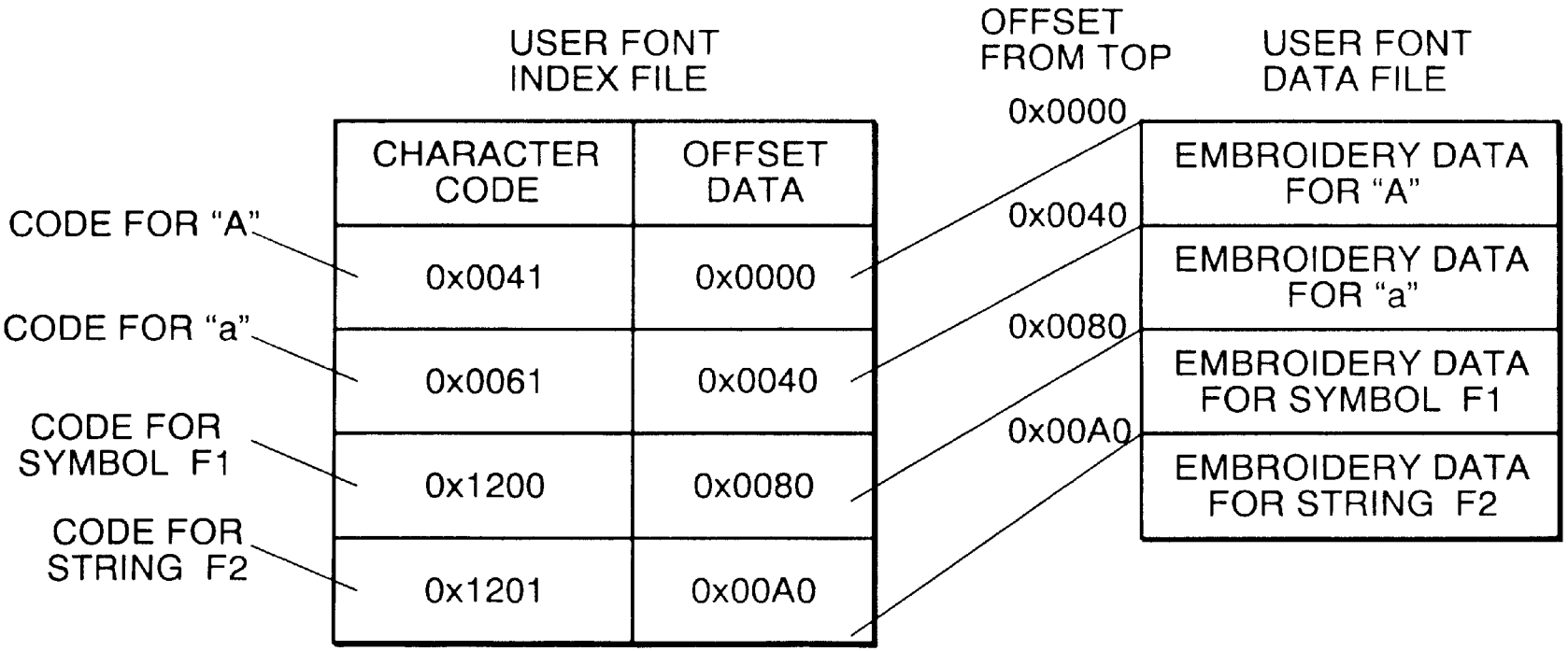
FIG. 12 shows an example of embroidery data registered with the user embroidery font file using undefined codes.

Further, the embroidery patterns to be registered can include generally used embroidery stitch patterns. To the patterns which do not correspond to the character codes in a character code system (e.g., the Unicode system), undefined codes of the code system may be assigned. FIG. 12 shows an example in which the patterns F1 and F2 shown in FIGS. 10 and 11 are registered using undefined codes [0x1200] and [0x1201] of the Unicode 1.1 system.

Although the Unicode system is used as a character code system in the embodiment, other character code systems such as the shifted JIS code system can be used.

As described above, according to the invention, an embroidery data which is not included in the system embroidery font file can be created and registered with the user embroidery font file. Further, the registered data can be retrieved by the same operation for retrieving data included in the system embroidery font file.

The present disclosure relates to the subject matter contained in Japanese Patent Application No. HEI 09-27515, filed on Feb. 12, 1997, which is expressly incorporated herein by reference in its entirety.

What is claimed is:

1. An embroidery data processing system, comprising:

a system embroidery data storing device, which stores system embroidery data, said system embroidery data including data of a plurality of embroidery patterns and codes assigned to said data of a plurality of embroidery patterns, respectively;

a user embroidery data storing device, which stores user embroidery data, said user embroidery data including data of embroidery patterns input by a user and codes assigned to said data of embroidery patterns input by said user, respectively;

a code input device through which a code is input; and a data searching device, which automatically searches said system embroidery data storing device and said user embroidery data storing device for embroidery data corresponding to the code input through said code input device.

2. The embroidery data processing system according to claim 1, further comprising:

an embroidery data editing device for creating new embroidery data;

a code assigning device which assigns a code to said new embroidery data created by said embroidery data editing device; and a data registering device which stores said new embroidery data created by said embroidery data editing device and said code assigned to said new embroidery data with said user embroidery data storing device.

3. The embroidery data processing system according to claim 2, wherein said embroidery data editing device creates said new embroidery data by modifying data of a pattern included in said system embroidery data storing device.

4. The embroidery data processing system according to claim 2, wherein said embroidery data editing device creates said new embroidery data by modifying data of a pattern included in said user embroidery data storing device.

5. The embroidery data processing system according to claim 2, further comprising an embroidery pattern data creating device, wherein said embroidery data editing device creates said new embroidery data by modifying embroidery pattern data created by said embroidery pattern data creating device.

6. The embroidery data processing system according to claim 1, wherein, for a piece of pattern data included in said user embroidery data and corresponding to a piece of pattern data included in said system embroidery data, said user embroidery data storing device stores the same code as a code assigned to said piece of pattern data included in said system embroidery data in association with said piece of pattern data included in said user embroidery data.

7. The embroidery data processing system according to claim 1, wherein if both of said system embroidery data and said user embroidery data include data corresponding to a code, said selecting device selects data included in said user embroidery data.

8. The embroidery data processing system according to claim 1, wherein said system embroidery data includes pattern data of alphanumerical characters, and wherein said code assigned to each pattern data of said system embroidery data follows a predetermined character code system.

9. The embroidery data processing system according to claim 1, wherein said system embroidery data includes pattern data of symbols, and wherein said code assigned to each pattern data of said system embroidery data follows a predetermined character code system.

10. The embroidery data processing system according to claim 1, wherein said system embroidery data includes pattern data of a string consisting of alphanumerical characters and/or symbols, and wherein said code assigned to each pattern data of said system embroidery data comprises an undefined code of a predetermined character code system.

11. The embroidery data processing system according to claim 8, wherein said user embroidery data includes pattern data of alphanumerical characters, and wherein said code assigned to each pattern data of said user embroidery data follows said predetermined character code system.

12. The embroidery data processing system according to claim 9, wherein said user embroidery data includes pattern data of symbols.

13. The embroidery data processing system according to claim 12, wherein said code assigned to each pattern data of said user embroidery data follows said predetermined character code system.

14. The embroidery data processing system according to claim 13, wherein said code assigned to each pattern data of said user embroidery data comprises an undefined code of said predetermined character code system.

15. The embroidery data processing system according to claim 10, wherein said user embroidery data includes pattern data of a string consisting of alphanumerical characters and/or symbols.

16. The embroidery data processing system according to claim 15, wherein said code assigned to each pattern data of said user embroidery data comprises an undefined code of said predetermined character code system.

17. The embroidery data processing system according to claim 1, further comprising a data storing medium which stores embroidery data found by said searching device.

18. The embroidery data processing system according to claim 17, wherein said data storing medium can be detachably connected to an embroidery sewing machine, said embroidery data stored in said data storing medium being transmissible from said data storing medium to said embroidery sewing machine when said data storing medium is connected to said sewing machine.

19. A memory medium for storing programs for an embroidery data processing system, said programs comprising:

a program for storing system embroidery data which includes data of a plurality of embroidery patterns and codes assigned to said data of a plurality of embroidery patterns, respectively;

a program for storing user embroidery data which includes data of embroidery patterns input by a user and codes assigned to said data of embroidery patterns input by said user, respectively;

a program for receiving an input of a code; and a program for searching said system embroidery data and said user embroider data for embroidery data corresponding to said input code.

20. An embroidery data processing system, comprising:

means for storing system embroidery data, said system embroidery data including data of a plurality of embroidery patterns and codes assigned to said data of a plurality of embroidery patterns, respectively;

means for storing user embroidery data, said user embroidery data including data of embroidery pattern input by a user and codes assigned to said data of embroidery patterns input by said user, respectively;

means for receiving an input of a code from said user; and means for searching said system embroidery data storing means and said user embroidery storing means for embroidery data corresponding to said code received by said input receiving means.

21. The embroidery data processing system according to claim 1, wherein said system embroidery data storing device is searched by said searching device if embroidery data corresponding to the code input through the code input device is not found in said user embroidery data storing device.

22. The memory medium according to claim 19, wherein said searching program searches said system embroidery data if the embroidery data corresponding to said input code is not found in said user embroidery data.

23. The memory medium according to claim 19, wherein said searching program selects embroidery data included in the user embroidery data if said searching program finds embroidery data corresponding to said input code in both said system embroidery data and said user embroidery data.

24. The embroidery data processing system according to claim 20, wherein said searching means searches said system embroidery data stored in said system embroidery storing means if embroidery data corresponding to said input code is not found in said user embroidery data stored in said user embroidery data storing means.

25. The embroidery data processing system according to claim 20, wherein said searching means selects embroidery data stored in said user embroidery data storing means if said searching means finds embroidery data corresponding to said input code in both said system embroidery data storing means and said user embroidery data storing means.

* * * * *